US006904887B2

(12) United States Patent
Higashide et al.

(10) Patent No.: US 6,904,887 B2
(45) Date of Patent: Jun. 14, 2005

(54) ENGINE ACCESSORY DRIVE SYSTEM

(75) Inventors: Shinji Higashide, Mori-machi (JP); Hiroyuki Higuchi, Mori-machi (JP); Azmi Osman, Mori-machi (JP)

(73) Assignee: Kabushiki Kaisha YED, Mori-machi (JP)

( * ) Notice: Subject to any disclaimer, the term of this patent is extended or adjusted under 35 U.S.C. 154(b) by 0 days.

(21) Appl. No.: 10/708,972

(22) Filed: Apr. 5, 2004

(65) Prior Publication Data

US 2004/0200452 A1 Oct. 14, 2004

(30) Foreign Application Priority Data

Apr. 10, 2003 (JP) ..... 2003-107042

(51) Int. Cl.[7] ..... F02F 7/00

(52) U.S. Cl. ..... 123/195 A; 123/195 H

(58) Field of Search ..... 123/195 R, 195 A, 123/195 H

(56) References Cited

U.S. PATENT DOCUMENTS 3,449,032 A * 6/1969 Scheufler ..... 384/278

FOREIGN PATENT DOCUMENTS

JP 06-299863 10/1994

OTHER PUBLICATIONS

JPO abstract for JP 6–299863 A, Kasahara, Oct. 25, 1994.*

* cited by examiner

*Primary Examiner*—Andrew M. Dolinar
(74) *Attorney, Agent, or Firm*—Ernest A Beutler

(57) ABSTRACT

An internal combustion engine providing a strong mounting attachment for an engine accessory component on a light weight element of the engine body that is provided with a reinforcement for another primary purpose.

9 Claims, 8 Drawing Sheets

ENGINE ACCESSORY DRIVE SYSTEM

BACKGROUND OF INVENTION

This invention relates to an engine accessory drive system and more particularly to an improved arrangement for mounting a component of the accessory on a light weight casting of the engine body without requiring special reinforcing in the mounting assembly.

Frequently an engine accessory is mounted on a light weight casting of an engine body to provide a convenient mounting relationship. For example it has been proposed to mount an oil pump for the engine on an alloy bulkhead member that cooperates with the alloy cylinder block to journal the engine crankshaft. Generally this type of arrangement provides a flexible transmitter drive for driving the oil pump from the engine crankshaft. This type of drive normally requires a tensioner mechanism for maintaining the proper tension in the transmitter. These tensioners are spring biased and the spring loading places a high stress on the alloy casting that might cause problems. An example of this type of construction is shown in Japanese published application, publication number Hei 6-299863. This requires reinforcing of the alloy casting, which adds to the expense.

In the aforenoted crankshaft journaling arrangements it has been proposed to embody ferrous reinforcements in at least one of the alloy castings to reinforce the casting in the area where the crankshaft is journalled. Examples of such reinforcing may be seen in U.S. Pat. Nos. 4,693,216 and 5,769,546. However the use of these reinforcements has been limited to the journaling of the crankshaft.

It is therefore a principle object of this invention to provide an improved and simplified reinforcement for the mounting of an engine driven assembly component on a light alloy casting thereof.

It is a further object of the invention to utilize a reinforcing member in a light alloy casting provided for another purpose, for the mounting of the engine driven assembly component.

SUMMARY OF INVENTION

This invention is adapted to be embodied in an internal combustion engine and bearing arrangement for an engine driven accessory. The engine has a driven shaft journalled by a pair of mating light alloy castings. A reinforcing element formed from a stronger material than the casting is embedded in one of the mating castings. In accordance with the invention, a component of the engine driven accessory is supported directly by the reinforcing element.

DETAILED DESCRIPTION

Figure 1:
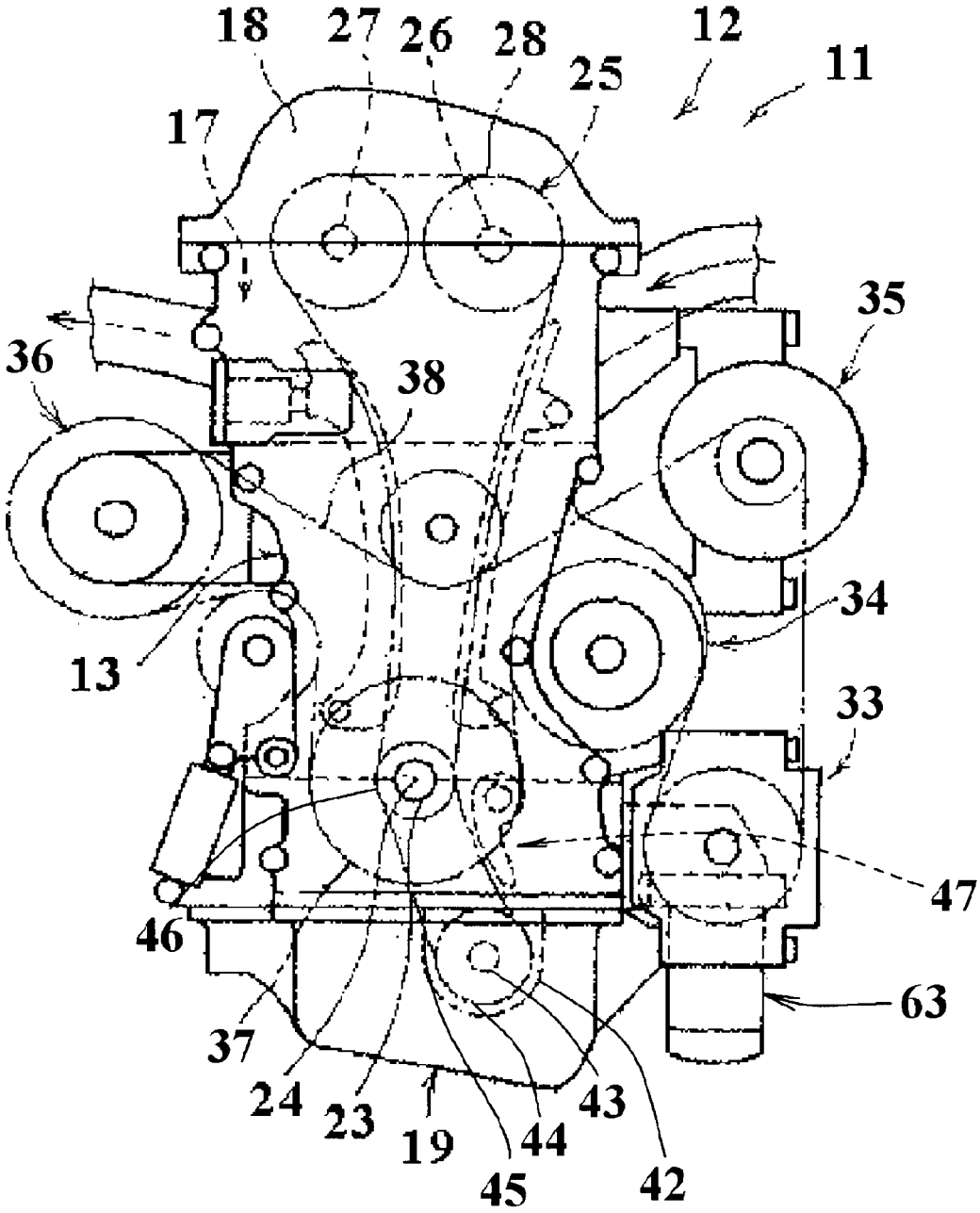
FIG. 1 is a front elevational view of an internal combustion engine and accessory drive constructed in accordance with an embodiment of the invention.
Figure 2:
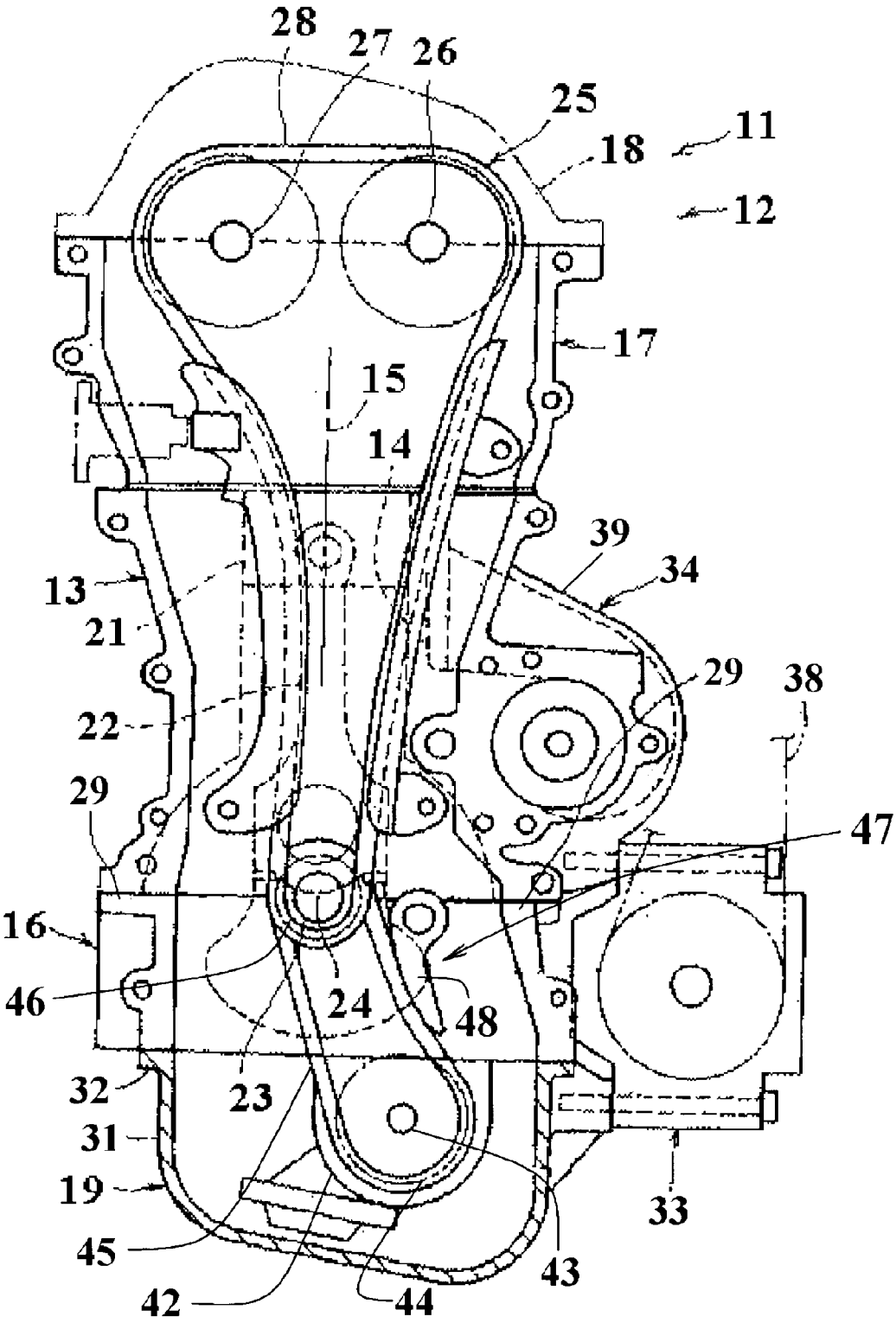
FIG. 2 is an enlarged front elevational view of the engine looking in the same direction as FIG. 1, but with the timing cover of the engine removed.
Figure 3:
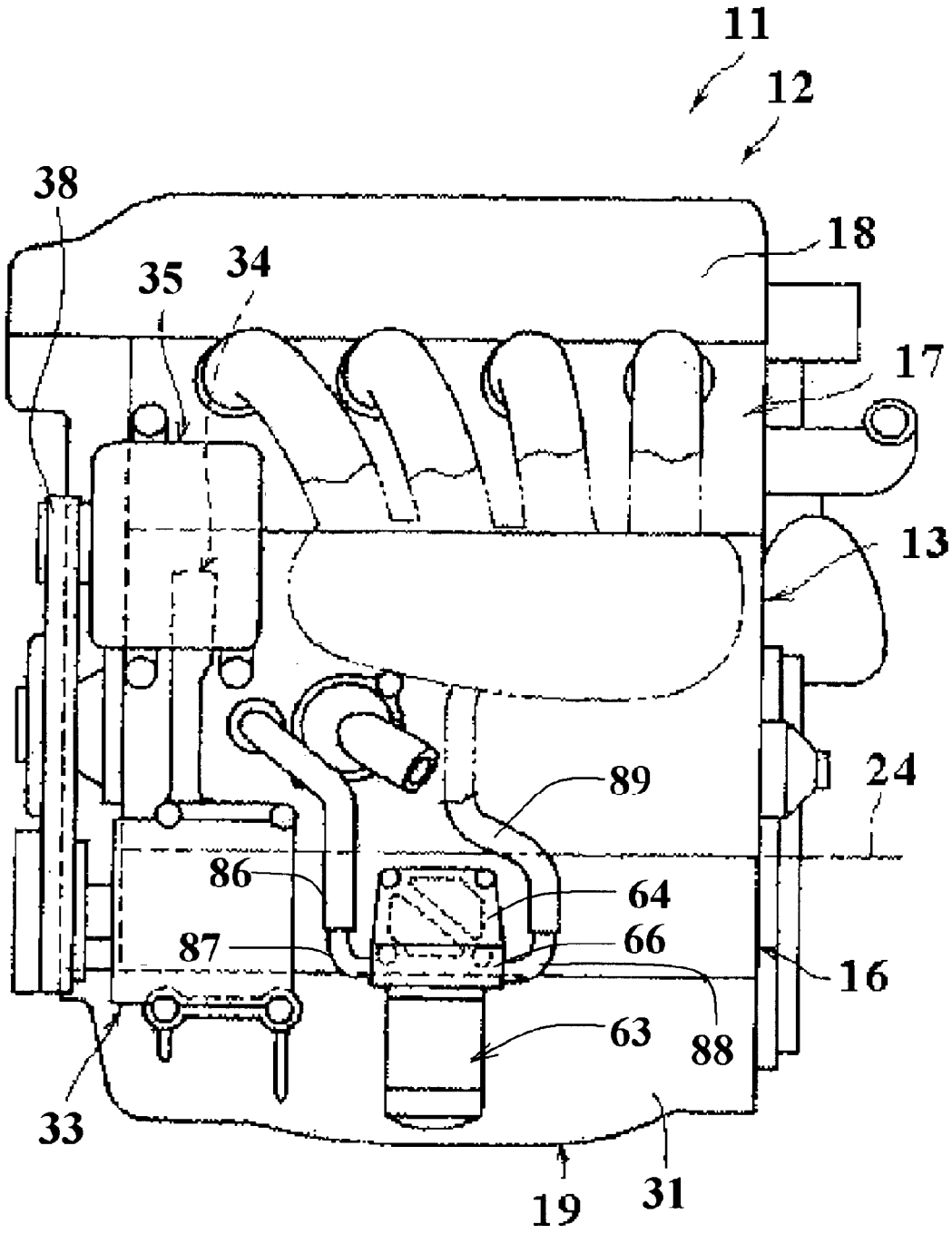
FIG. 3 is a side elevational view of the engine.

Referring now in detail to the drawings and initially primarily to FIGS. 1–3, a multi-cylinder, four-stroke internal combustion engine embodying the invention is indicated generally by the reference numeral 11. In the illustrated embodiment the engine 11 is shown as having four in line cylinders. Of course, from the following description it will be obvious to those skilled in the art, that the invention can be utilized with engines having other numbers of cylinders and other engine configurations. In addition the invention is not limited to engines operating on the four stroke principle.

The engine 11 is adapted to be mounted on and power a vehicle such as an automobile and is depicted as being mounted vertically therein, although the invention is not so limited. The engine 11 has an engine body, indicated generally at 12 supported in a suitable fashion by a vehicle body (not shown). The engine body 12 is comprised of a cylinder block, indicated generally at 13. The cylinder block 13 is formed with four cylinder bores 14 (FIG. 2) having parallel axes 15. Detachably affixed, in a known manner, to the lower end of the cylinder block 13 is a bulkhead, indicated generally at 16, to form the upper portion of a crankcase assembly.

A cylinder head assembly 17 is secured to the upper face of the cylinder block 13 in a known manner and closed the upper ends of the cylinder bores 14. The cylinder head assembly 17 supports valves for controlling the admission of a charge into the engine combustion chambers and the discharge of exhaust gasses therefrom in any suitable manner and as is well known in this art. These valves are operated in a manner to be described. This valve and operating mechanism is enclosed by a cylinder head cover 18 that is secured to the upper face of the cylinder head 17.

The aforementioned crankcase assembly, the upper portion of which is formed by the lower part of the cylinder block 13 and bulkhead 16 is completed and closed by an oil pan, indicated generally at 19, that is suitably secured to the lower face of the bulkhead 16 and contains lubricating oil.

The engine 11 is provided with pistons 21 reciprocating in the cylinder bores 14 and connected by connecting rods 22 to drive a crankshaft 23. The crankshaft 23 rotates about an axis 24 that extends generally horizontally. The crankshaft 23 is journalled about this axis 24 by bearings carried by the cylinder block 13 and bulkhead 16 in a manner as will be described.

The previously mentioned intake and exhaust valves (not shown) are operated in a suitable manner by a valve actuating mechanism, indicated generally at 25. This valve actuating mechanism 25 is comprised of an intake camshaft 26 and an exhaust camshaft 27 in suitable operational engagement with the intake valves and exhaust valves, respectively. The camshafts 26 and 27 haves axes that extend parallel to the axis 24 of the crankshaft 23. A timing chain 28 interconnects a sprocket provided on one end of the crankshaft 23, to be described later, with sprockets on the ends of the camshafts 26 and 27 to drive them in timed relation at one half the rotational speed thereof.

As has been noted, the cylinder block 13 is made by casting, and preferably of low pressure cast aluminum with the cylinder head 17 formed of the same material and fixed to the upper face thereof in a known manner. The afore-described crankcase assembly and specifically an upper flange 29 of the bulkhead 16 is affixed thereto in any suitable manner. The oil pan 19 has a generally dish-shaped oil pan body 31 opening upward and an outward flange 32 formed integrally with the upper outer edge of the oil pan body 31 that is sealingly engaged with the lower face of the bulkhead 16 to add to the rigidity of the structure.

The engine 11 is provided with a number of accessories disposed in the outer lateral vicinity of the engine body 12. Some of these accessories are for engine operation while others are for vehicle or other purposes. These include an air conditioning compressor 33 for vehicle air conditioning, an engine coolant pump 34 for delivering coolant to a coolant jacket formed in the engine body 12 to cool the engine body 12, an alternator 35 for generating electrical power for the vehicle and engine ignition, and a power steering pump 36 for power assist of the vehicle steering. Each of these accessories 33, 34, 35 and 36 are driven in a well known manner from a pulley 37 that is affixed to the crankshaft 23 by means of a serpentine belt 38.

As has been noted, the engine driven accessories include the coolant pump 34. This pump 34 has an outer housing that is integral with the cylinder block 13 and thus reinforces it. This outer housing includes a discharge duct portion 39 that communicates with cooling jackets 41 (FIG. 2) formed in the cylinder block 13 around the cylinder bores 14. These cooling jackets 41 also cooperate with cooling jackets (not shown) formed in the cylinder head 17. The coolant also passes through a heat exchanger (not shown) in a manner well known in the art.

In addition to the cooling system just described and in accordance with the invention, the engine 11 is provided with a lubricating system that includes the crankcase assembly and specifically the oil pan 19. The lubricant is supplied by this system to portions of the engine 11 to be lubricated such as bearings for the crankshaft 23 and the camshafts 26, 27. The lubricating system is provided with an oil pump 42 supported directly on the bulkhead 16 so that it protrudes downward from the lower face of the bulkhead 16 to be disposed in the oil pan 19.

Figure 4:
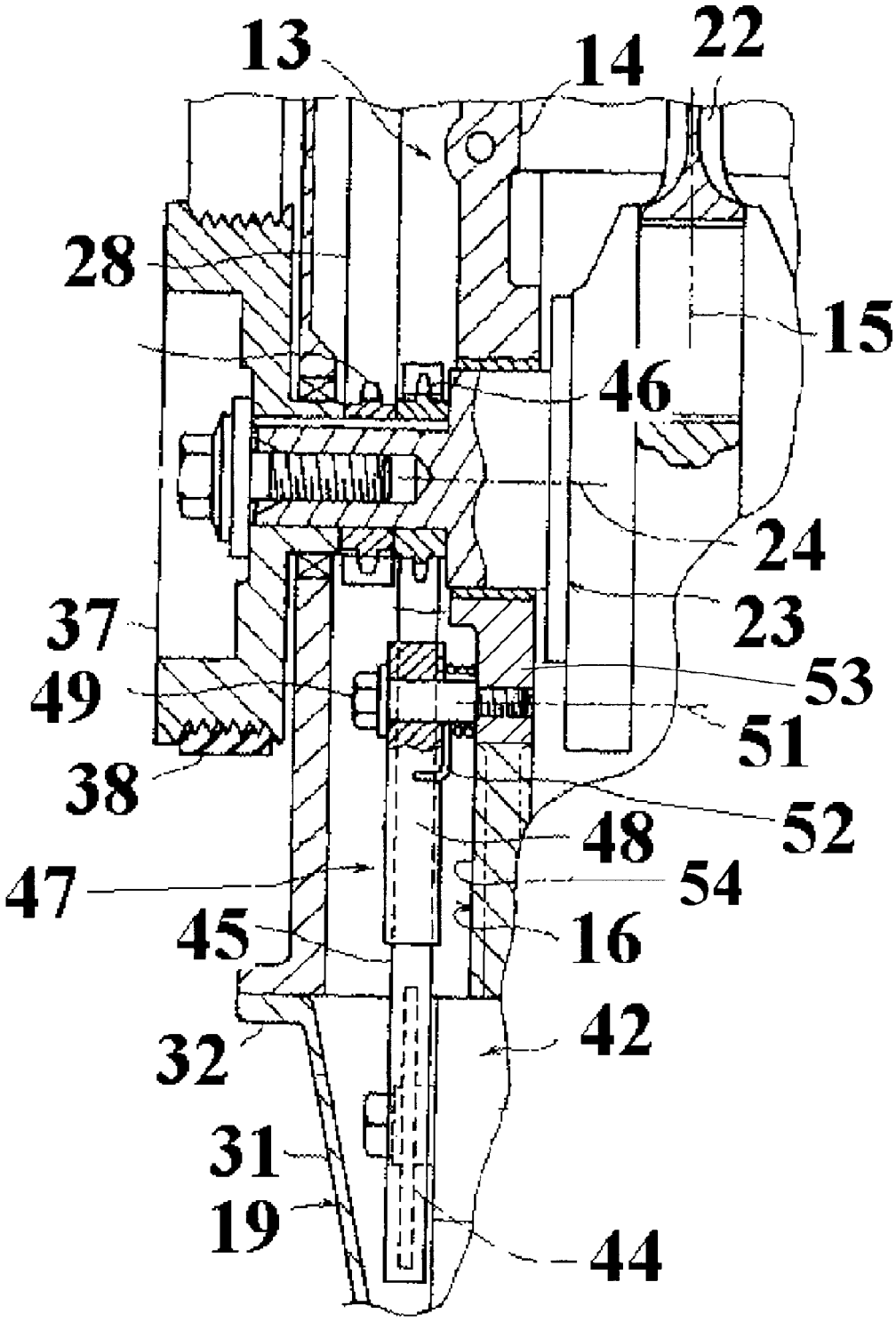
FIG. 4 is an enlarged cross sectional taken along the line 4—4 in FIG. 2.
Figure 5:
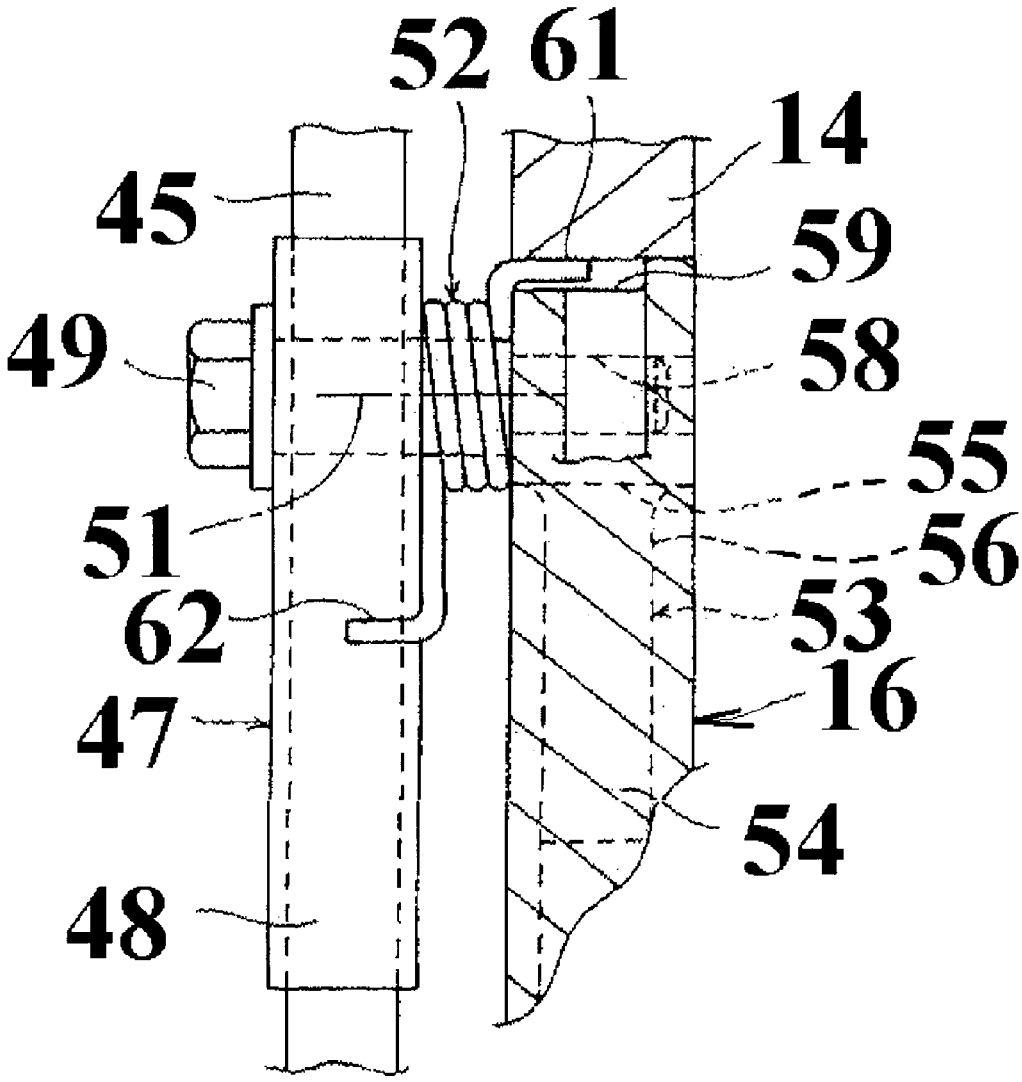
FIG. 5 is a further enlarged view, in part similar to FIG. 4, but shows the tensioner arm in solid lines and is taken along the line 5—5 of FIG. 6
Figure 6:
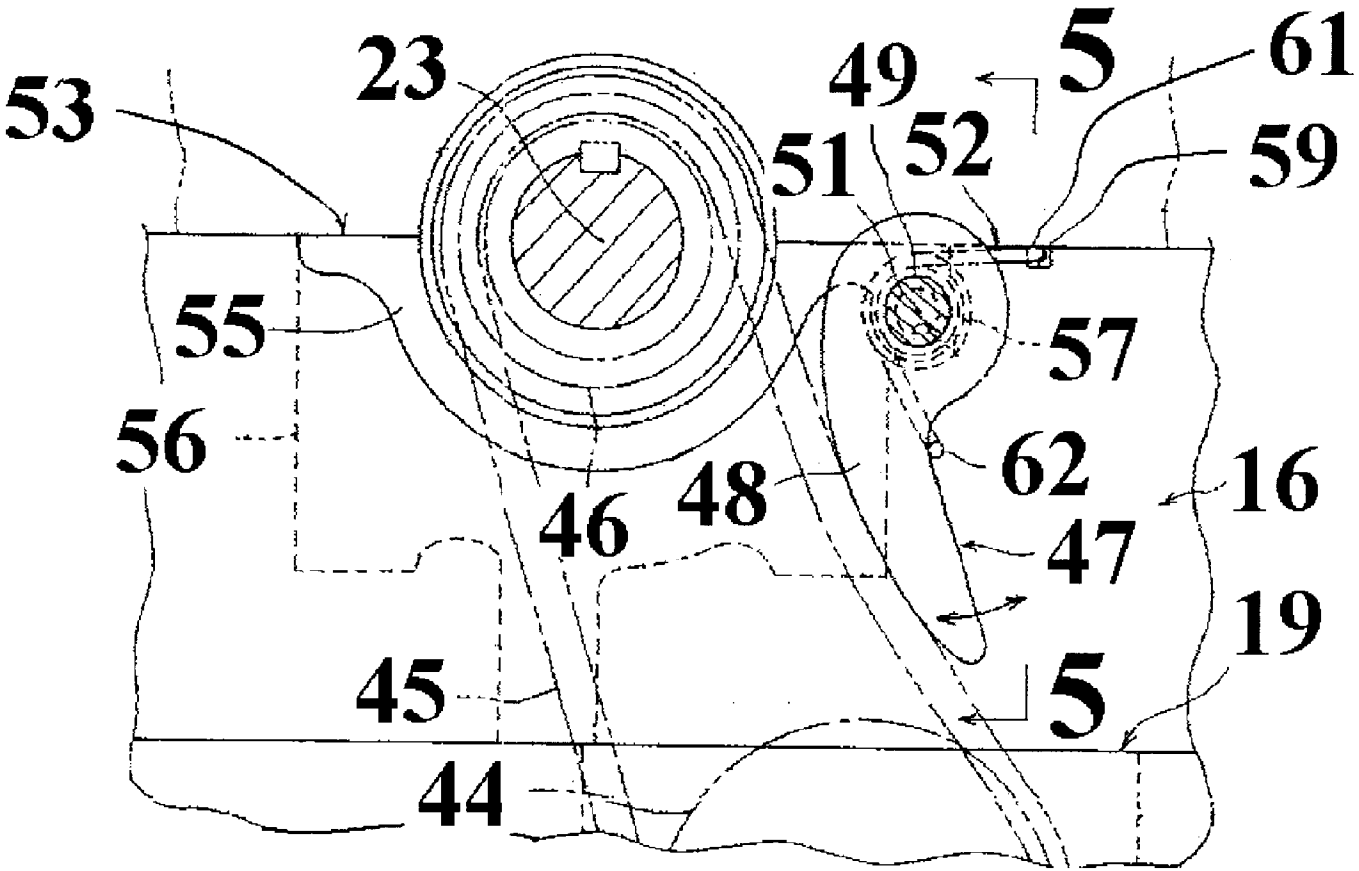
FIG. 6 is a front elevational view of the structure shown in FIG. 5. with the tensioner and crankshafts being shown in section.

The oil pump 42 may be of any known type and has a drive shaft 43 to which a sprocket 44 affixed to an end thereof that extends outwardly in the oil pan 19. The sprocket 44 is driven by a driving chain 45 that is driven in turn by a sprocket 46 fixed to one end of the crankshaft 23. This drive will now be described in more detail by primary reference to FIGS. 4–6. There is provided a tensioner mechanism, indicated generally by the reference numeral 47, for maintaining the desired tension in the oil pump driving chain 45.

The tensioner 47 is includes a tension arm 48, one end of which is pivoted on the bulkhead 16 by a pivot shaft 49 so that the other end can be rotated about an axis 51 defined by the pivot shaft 49. The other end of the arm 48 is urged into contact with the chain 45 by a spring, indicated generally at 52, to maintain the desired tension. tensioner mechanism 47 is supported in a manner that embodies the invention and which will be described in detail by continued reference to FIGS. 4–6.

In order to reinforce the bearing support for the crankshaft 23 in the bulkhead 16, the webs of the bulkhead 16 that journal the crankshaft 23 and particularly the forward most end web, a cast iron reinforcement 53 is embedded in the bulkhead body web 54 by insert molding in casting the bulkhead 16 for reinforcing a bearing part for the crankshaft 16. In the illustrated embodiment, the reinforcement 53 actually carries the bearing for the crankshaft 23. To this end, the reinforcement 53 is provided with an arcuate reinforcement portion 55 extending in the circumferential direction of the crankshaft 23 along its lower face for supporting the lower half of the crankshaft 23. A support portion 56 protrudes integrally downward from the reinforcement portion 55 and is embedded in the bulkhead web 54 to support the reinforcement portion 55. An integral boss 57 protrudes radially outward from the side of reinforcement body 55 adjacent the tensioner 47.

The tensioner arm 48 is pivotally supported by the reinforcement 55 and particularly by its boss 57. Specifically, a female threaded hole 58 is formed in the boss 57 of the reinforcement 55 on the axis 51. A male threaded end of the pivot shaft 52 is threaded into the female threaded hole 58, whereby the pivot shaft 52 is supported on the boss 57 to journal the tensioner arm 48.

The side of the bulkhead web 54 facing the cylinder block 13 is formed with a groove 59 extending in the axial direction in the vicinity of the tensioner 47. The groove 59 is open at the forward end and closed at its rearward end. One end 61 of the spring 52 is fitted into the open end of the groove 59. The spring 52 has another end 62 that is engaged with the tension arm 48 so as to urge the tension arm 48 into pressure contact with the chain 45 to maintain the desired tension in the chain 45.

Figure 7:
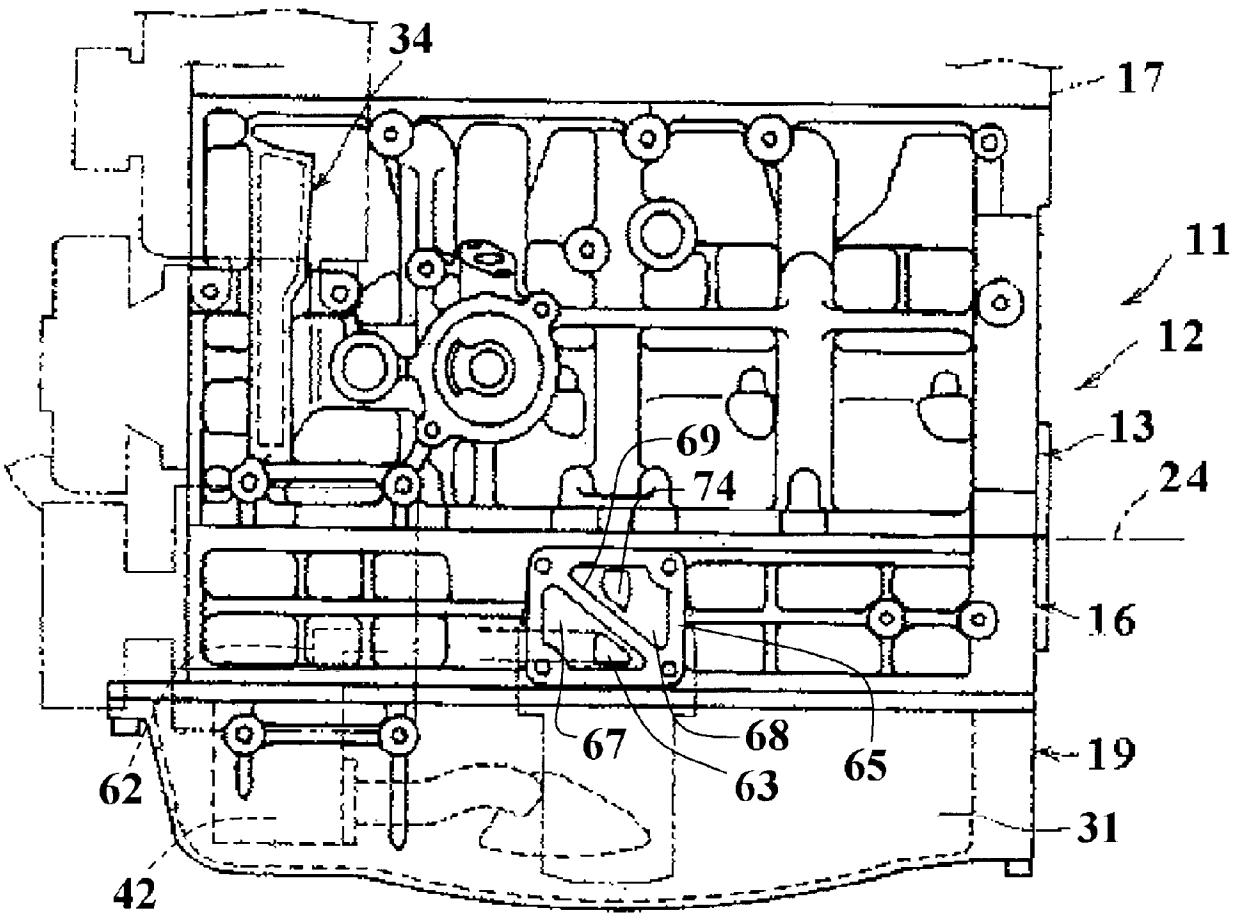
FIG. 7 is a side elevational view looking in the same direction as FIG. 3, showing only the assembled cylinder block and crankcase assembly in solid lines and some of the engine accessories in phantom.
Figure 8:
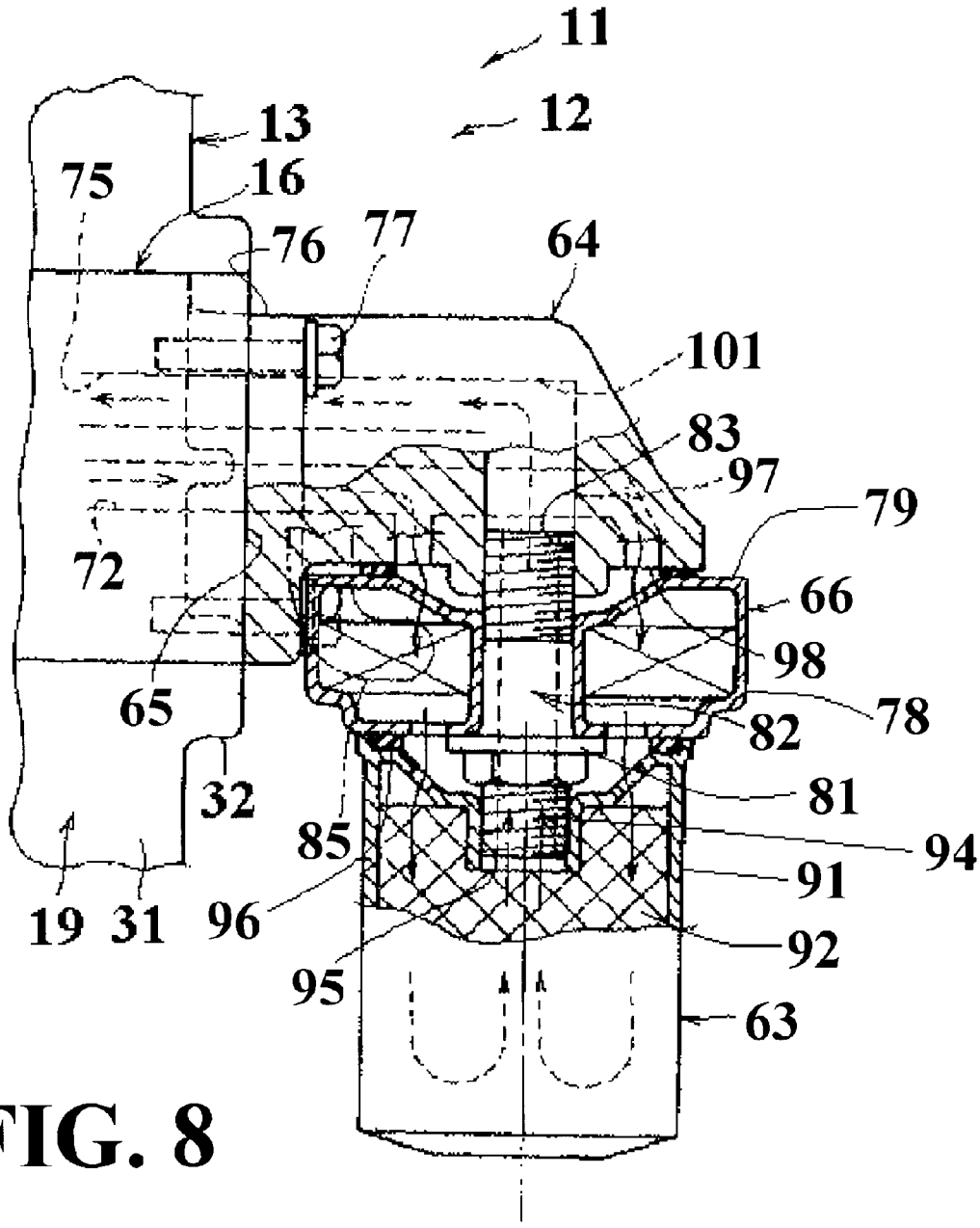
FIG. 8 is an enlarged view looking in the same direction as FIG. 1, of the oil filter and mounting arrangement therefore with portions broken away and shown in section.

Referring now back to the remaining figures of the drawings and particularly initially to FIGS. 3, 7 and 8, the oil pump 42 supplies its pumped lubricant to the lubricated components of the engine 11 through a feed system that includes a removable oil filter of the cartridge type, indicated generally by the reference numeral 63. This is mounted on the engine 11 and particularly on the bulkhead 16 by a mounting bracket, indicated generally at 64 as shown best in FIG. 8. This mounting bracket 64 is affixed, in a manner to be described shortly, on a mounting pad 65 formed integrally on a side face of the bulkhead 16.

In addition to carrying the oil filter 63, the mounting bracket 64 carries an oil cooler, indicated generally by the reference numeral 66. This oil cooler 66 is interposed, in a manner to be described shortly, between the mounting bracket 64 and the oil filter 63. Referring now additionally to FIG. 7, it will be seen that the mounting pad 65 is formed as an outward projection of the side face of the bulkhead 16 and defines an inlet cavity 67 and a discharge cavity 68 that are separated by an angularly disposed dividing wall 69.

Continuing to refer primarily to FIGS. 7 and 8, it will be seen that the oil pump 42 discharges the pumped oil in a vertical direction to enter a vertically extending passage 71 that extends in the bulkhead 16 from its lower face. This vertical passage 71 intersects a horizontal passage 72 that terminates in the inlet cavity 67 of the mounting pad 65 via an opening 73.

After passing through the oil cooler 66 and the filter 63, in a manner to be described shortly, the cooled and filtered lubricant is delivered to the discharge cavity 68 for delivery to the lubricated components of the engine 11 through an opening 74 of the main oil gallery of the engine 11 that is formed initially in the bulkhead 16. The opening 74 communicates with the initial part of the main oil gallery, indicated by the reference numeral 75, that is formed in the bulkhead 16 as seen in FIG. 8. From there the oil passes to the aforenoted lubricated components of the engine through suitable passages, as is well known in the art.

Continuing to refer primarily to FIG. 8, it will be seen that the mounting bracket 64 which is formed separately from the bulkhead 16 has a pair of side flanges 76 that have openings for receiving fasteners 77 for removable attachment to the mounting pad 65 formed on the outer lateral face of the bulkhead 16.

The oil cooler 66 has an outer housing 78 of a generally ring shape with a generally flat upper surface 79 that is held in sealing relation with a mating lower surface of the mounting bracket 64 by means of a shoulder 81 of a fastener, indicated generally by the reference numeral 82. The fastener 82 has a threaded portion 83 that is received in a tapped opening of the mounting bracket 64 to load a sealing gasket 84 between the mating face 79 of the oil cooler 66 and the mounting bracket 64.

Positioned within the oil cooler body 78 is a heat exchanger 85 that receives engine coolant from the engine cooling jacket 41 via a conduit 86 and fitting 87 (FIG. 3). After this coolant passes through the heat exchanger 75 it is returned to the cooling jacket 41 via a return fitting 88 and return conduit 89.

Referring again to FIG. 8, the oil filter 63, as has already been noted, is of the canister type and includes a can shaped outer housing 91 in which a filter media of any desired type 92 is received. This outer housing is formed with an end wall 93 having a tapped opening 94 that is threaded onto a lower threaded portion 95 of the fastener 82. A sealing ring 96 is thus sealingly compressed between the end wall 93 and the lower face of the heat exchanger body 78.

The cylinder block oil passage 72 mates with an oil delivery passage 97 formed in the mounting bracket 64 that terminates in a plurality of downwardly opening passages to communicate with the upper wall of the oil cooler 66 in the area inwardly of the sealing gasket 84. The oil cooler outer housing has a plurality of openings 98 in this area to permit oil to enter into the oil cooler 66 for cooling in the direction indicated by the arrows.

In a like manner the lower wall of the oil cooler housing 78 has a plurality of discharge openings to permit the oil to enter the area of the oil filter end wall 83 inwardly of the sealing ring 86 again as shown by the flow indicating arrows. The oil then enters the oil filter 63 to flow through the filter media 82 through openings in the end wall 93 as also shown by the flow indicating arrows.

The thus cooled and filtered oil then exits the filter 63 and cooler 66 through an internal passage 99 formed in the fastener 82. The oil then flows into a delivery passage 101 formed in the mounting bracket 64, as again shown by the flow arrows. The delivery passage 9101 in turn communicates with the initial part 75 of the engine main oil gallery formed in the bulkhead 16 to deliver the cooled and filtered oil to the engine 11. After the lubrication, the lubricating oil is returned to the oil pan 19 in any known manner for repeated delivery by the oil pump 42.

In the above case, the oil filter 63 and the oil cooler 66 are both located on an axis defined by the fastener 82. The lubricating oil flows in an axial direction evenly through the oil filter 63 and the oil cooler 66, and returns through the passage 89 in the fastener 82. Thus, the filtration of the lubricating oil by the oil filter 63 and the cooling by the oil cooler 66 can be achieved effectively.

Since all of the oil delivery passages and return passages between the oil pump 42, the oil cooler 66, oil filter 63 and the engine lubricating main gallery 75 are formed in a single engine body piece, in this case the bulkhead 16, the number and location of sealing surfaces required by the prior art constructions is substantially reduced with not only cost savings but good insurance against leakage. Also, since the bracket 64 is a separate body from the bulkhead 16, it is possible to select a variety of postures and positions of the oil filter 63 and the oil cooler 66, which are secured to the bracket 64, by selecting a variety of shapes of the bracket 64. Therefore, adoption of suitable postures and positions of the oil filter 63 and the oil cooler 66 permits arranging the engine body 12, the oil filter 63, and the oil cooler 66 in a compact manner, thereby preventing the lubricating system from being oversized.

From the foregoing description it should be readily apparent to those skilled in the art that the described construction is highly effective in providing a strong mounting attachment for an engine accessory component on a light weight element of an engine body. Of course those skilled in the art will readily understand that the described embodiment is only exemplary of forms that the invention may take and that various changes and modifications may be made without departing from the spirit and scope of the invention, as defined by the appended claims. For examples only, the engine 11 may be a two-stroke engine and/or the axes 15 of the cylinder bores 14 may be inclined with respect to the vertical.

What is claimed is:

1. An internal combustion engine and bearing arrangement for an engine driven accessory, said engine having a driven shaft journalled by a pair of mating light alloy castings, a reinforcing element formed front a stronger material than said castings embedded in one of said mating castings, said driven shaft being supported at least in part by the reinforcing element, and a component of said engine driven accessory being supported directly by said reinforcing element.

2. An internal combustion engine and bearing arrangement as set forth in claim 1 wherein the pair of mating castings comprise a cylinder block and a bulkhead member cooperating to journal the engine driven shaft that comprises a crankshaft.

3. An Internal combustion engine and bearing arrangement as set forth in claim 2 wherein the engine driven accessory is driven from the crankshaft by a flexible transmitter.

4. An internal combustion engine and bearing arrangement for an engine driven accessory, said engine having a crankshaft journalled by a pair of mating light alloy castings, said engine driven accessory being driven from said crankshaft by a flexible transmitter, a reinforcing element formed from a stronger material than said castings embedded in one of said mating castings, and a tensioner for said flexible transmitter supported directly by said reinforcing element.

5. An internal combustion engine and bearing arrangement as set forth in claim 4 wherein the tensioner is comprised of a pivotally supported member for applying pressure to the flexible transmitter.

6. An internal combustion engine and bearing arrangement as set forth in claim 5 wherein the pivotal support for the member is provided by a pin carried directly by the reinforcing member.

7. An internal combustion engine and bearing arrangement as set forth in claim 5 wherein the pivotally supported member is biased by a torsional coil spring having an end engaged with the pivotally supported member and another end engaged with the bulkhead member.

8. An internal combustion engine and bearing arrangement as set forth in claim 7 wherein the other spring end is trapped in a slot formed in the bulkhead member and closed by the engagement of the bulkhead member with the cylinder block.

9. An internal combustion engine and bearing arrangement as set forth in claim 8 wherein the pivotal support for the member is provided by a pin carried directly by the reinforcing member.

* * * * *